US010822136B2

(12) United States Patent
Merritt

(10) Patent No.: US 10,822,136 B2
(45) Date of Patent: Nov. 3, 2020

(54) DUAL DISPENSER

(71) Applicant: Alyse N. Merritt, Land O'Lakes, FL (US)

(72) Inventor: Alyse N. Merritt, Land O'Lakes, FL (US)

( * ) Notice: Subject to any disclaimer, the term of this patent is extended or adjusted under 35 U.S.C. 154(b) by 0 days.

(21) Appl. No.: 15/913,852

(22) Filed: Mar. 6, 2018

(65) Prior Publication Data

US 2018/0222624 A1 Aug. 9, 2018

Related U.S. Application Data

(63) Continuation of application No. 29/558,909, filed on Mar. 23, 2016, now Pat. No. Des. 815,493.

(51) Int. Cl.

| | |
|---|---|
| ***B65D 21/024*** | (2006.01) |
| ***B65D 1/40*** | (2006.01) |
| ***B65D 25/20*** | (2006.01) |
| ***B65D 77/30*** | (2006.01) |
| ***B65D 77/20*** | (2006.01) |
| ***B65D 21/02*** | (2006.01) |

(52) U.S. Cl.

CPC ..... *B65D 1/40* (2013.01); *B65D 21/0204* (2013.01); *B65D 25/20* (2013.01); *B65D 77/2032* (2013.01); *B65D 77/30* (2013.01)

(58) Field of Classification Search

CPC .... B65D 21/0204; B65D 25/20; B65D 77/30; B65D 21/0201; B65D 21/0202; B65D 21/0234; B65D 35/22; B65D 35/02

USPC ..... 220/23.4; 215/6; 206/509

See application file for complete search history.

(56) References Cited

U.S. PATENT DOCUMENTS

| | | | | |
|---|---|---|---|---|
| 4,901,876 | A * | 2/1990 | Box | B65D 1/40 206/307.1 |
| 4,981,214 | A * | 1/1991 | Rojas | B65D 21/0228 206/430 |
| 5,862,949 | A * | 1/1999 | Markey | B65D 81/3288 222/143 |
| 2006/0151352 | A1* | 7/2006 | Harrington, IV | B65D 21/0204 206/509 |
| 2010/0258576 | A1* | 10/2010 | Marquez | A45C 11/20 220/737 |

* cited by examiner

*Primary Examiner* — Stephen J Castellano
(74) *Attorney, Agent, or Firm* — Robert Varkonyi; Zagrebelsky Law P.A.

(57) ABSTRACT

A dual dispenser has two front faces that are made from a hard plastic material thereby retaining its shape and resisting deformation thereof; here, each container is associated with a single front face as the body of the container is heat treated or adhesively attached to an appropriate edge of a corresponding front face. A dual dispenser as taught herein has a first container and a second container that each have a male member and female orifice associated with an appropriate front face of the first and second containers for a total of two male members and two female orifices. The male member of one front face is inserted within the female orifice of the second front face and vice versa so that the two containers engage one another across the front faces.

15 Claims, 12 Drawing Sheets

DUAL DISPENSER

This application is a continuation of design application serial No. 29/558,909 filed Mar. 23, 2016, now U.S. Design Pat. No. D815,493.

FIELD OF THE INVENTION

The present invention relates to devices intended to dispense gels, fluids, or condiments; more particularly, the present invention relates to devices that house two types of materials within the container space.

BACKGROUND OF THE INVENTION

Condiments are consumed in all sorts of restaurants and homes and are added to dishes in order to enhance the dining experience. The reason for adding condiments to a specific food item can range from the desire to add a particular flavor to the dish, accentuate the same or even to supplement the flavors already present within the food item.

There are a variety of sauces and seasoning that are commonly available in condiment packets; typically, fast food restaurants carry the ubiquitous ketchup and mustard condiments and some carry mayonnaise. Each of the servings is available in a single plastic package useable only once. Such a packet is known commonly as a sachet.

These small sachets are typically rectangular in shape and are made from a variety of common man made materials such as tin foil, mylar, plastic or similar materials. The packet is formed from two separate rectangular pieces of material that are brought into close proximity. Once three sides of each of the two rectangular pieces are brought together, these six sides are heat treated with a heating device at the edges to form a three sided pocket container.

Then another device inserts a condiment into the packet for later use. The final two edges of the bottom and top rectangular pieces are brought into physical proximity to each other through the aegis of another device. In this final step of sealing the sachet, a similar heating process closes the final edges between the top and bottom pieces so as to form a completed rectangular condiment package.

However, this typical type of condiment packet suffers from the fact that it can only dispense a single type of condiment. Additionally, as many patrons of fast food and other types of restaurants know, sometimes the sachet is inflexible and will not permit the easy release of the condiment held within. As almost everyone has experienced, the part of the device that is supposed to tear away allowing for easy dispensing of the condiment sometimes simply will not rip apart.

Toothpaste containers, gels, and other types of tube container are also ubiquitous and come in a variety of sizes, shapes, plastic thickness and type. They typically have a hard threaded head (having a matching similarly shaped cap) that has been combined through heat treatment with a body made from a single piece of plastic that has been folded over on itself and cut and adhesively sealed along the folded peripheries that have been brought together appropriately. However, these also only provide a single type of contents for ejection of materials therefrom.

Accordingly, there is a need to overcome the prior art deficiencies as indicated above.

SUMMARY OF THE INVENTION

The present invention overcomes the deficiencies of the known art and the problems that remain unsolved by providing a novel dispenser.

In accordance with one embodiment of the present invention, the invention

A dual dispenser has two front faces that are made from a hard plastic material thereby retaining its shape and resisting deformation thereof; here, each container is associated with a single front face as the body of the container is heat treated or adhesively attached to an appropriate edge of a corresponding front face.

A dual dispenser as taught herein has a first container and a second container that each have a male member and female orifice associated with an appropriate front face of the first and second containers for a total of two male members and two female orifices.

The male member of one front face is inserted within the female orifice of the second front face and vice versa so that the two containers engage one another across the front faces.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Example One

The dispenser package has two storage chambers and demonstrates how complementary products can come together in one packaging device. One side contains a condiment (or any liquid, gel, lotion or food product) such as ketchup, and the other side contains another product such as mustard. The ketchup and mustard are filled separately at a manufacturing plant, where on the back end of each side, an opening allows the products to be filled in. The material can be rigid injection molded plastic, or flexible foil, polyurethane or polyethylene, however the cap must be rigid.

Once both chambers are filled in with complementary products, they are heat sealed separately. The heat seal is made on the back end of the device, where the thumb flap is placed for easy pulling apart. The two chambers are then snapped together at the center, by their male and female parts. This device, and the products therein, can hold larger quantities of product and are resealable and reusable. For individual use, each side may contain its own plastic cap on the side, to seal as well. This way, if two people split up, each person can take their half and have a cap to place on each side as well.

Figure 1:
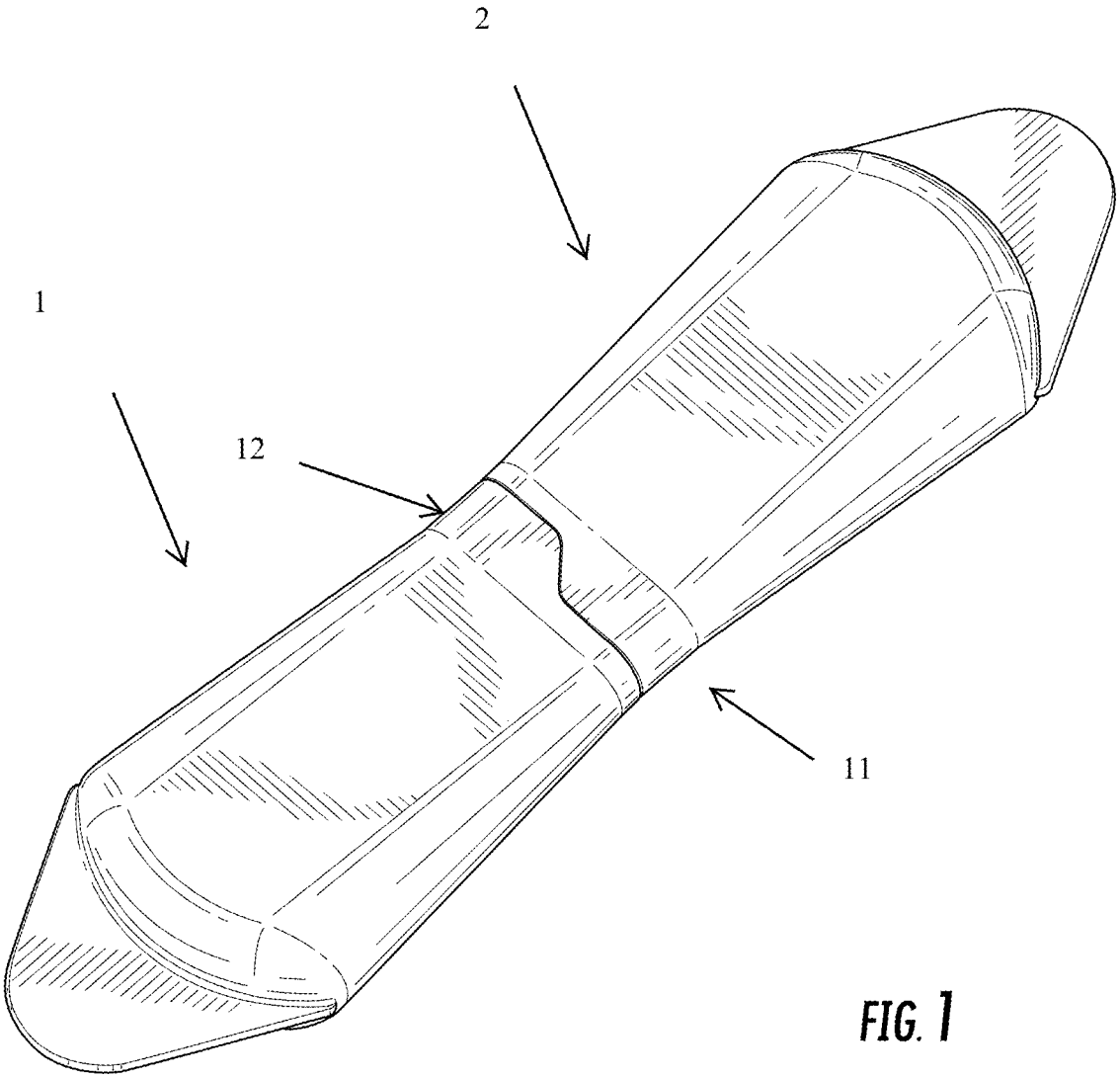
FIG. 1 is an isometric view of a dispenser in an embodiment disclosed herein.

FIG. 1 is an isometric view of a dispenser in an embodiment disclosed herein. The dispenser has two containers each having a container body 1, 2 made from a flexible plastic that is adhesively attached to a front hard face made from a rigid form of plastic. The front faces of this embodiment has two corresponding shrouds 11, 12 each one disposed about a part of a single respective front face 9, 10 which the shroud juts about and beyond a portion thereof as the front face is disposed opposite its counterpart. Each shroud 11, 12 diminishes in size along an angle at about the midpoint of its respective front face; it also integrally blends in with the rest of the front face such that the shroud llis integral with the front face of dispenser 2 and the shroud 12 is integral with the front face of dispenser 1. These shrouds 11, 12 provide extra physical support as these are brought together.

The main body of either container 1, 2 is typically made of two pieces of material that are heat treated or adhesively sealed along the respective lateral edges of the two pieces of material. When attached in this manner, the front end of the two pieces of material form an open space for locking engagement with the peripheral surface of the front face of the respective container. The back end of the two pieces of material forms another open space for insertion of condiments, gels, toothpaste and so forth. Once these are placed therein the back end is heat sealed (or adhesively closed with strong adhesive). A thumb flap is thus formed and if a weak adhesive is used at this triangular thumb flap, the device can be reused with a user separating the two pieces at the thumb flap selectively inserting materials therethrough and then re-closing the two pieced thereby reforming the thumb flap.

Figure 2:
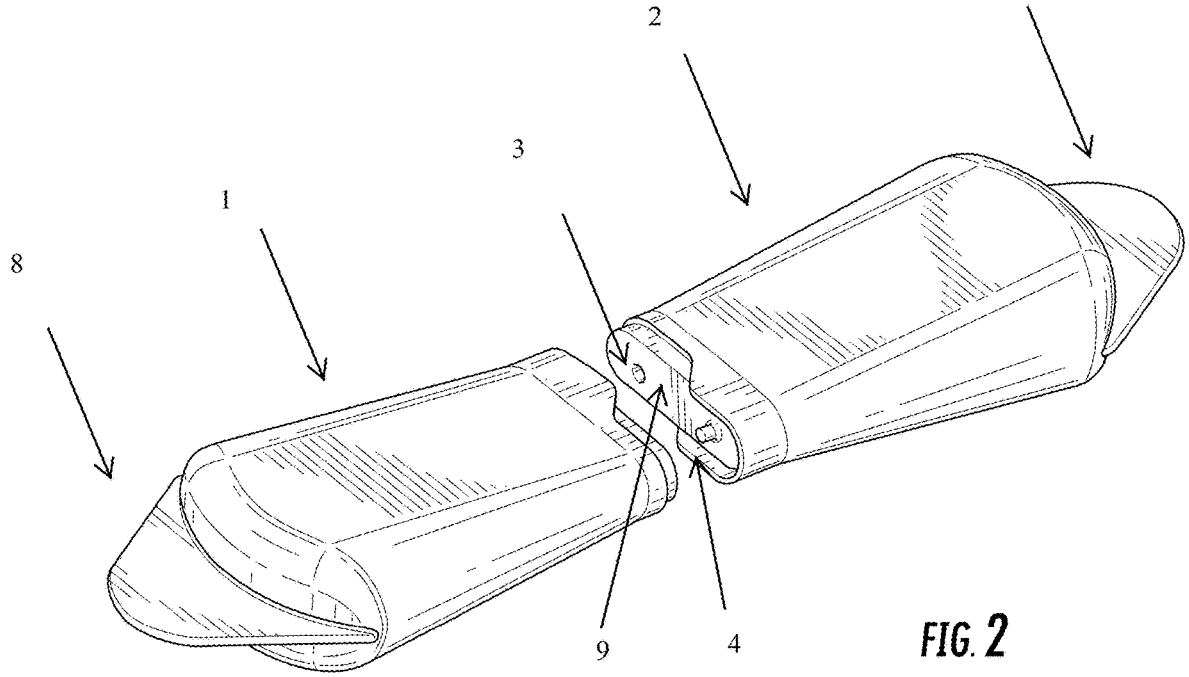
FIG. 2 is a top left front isometric view thereof with the dispenser showing more internal features between the two chambers.
Figure 3:
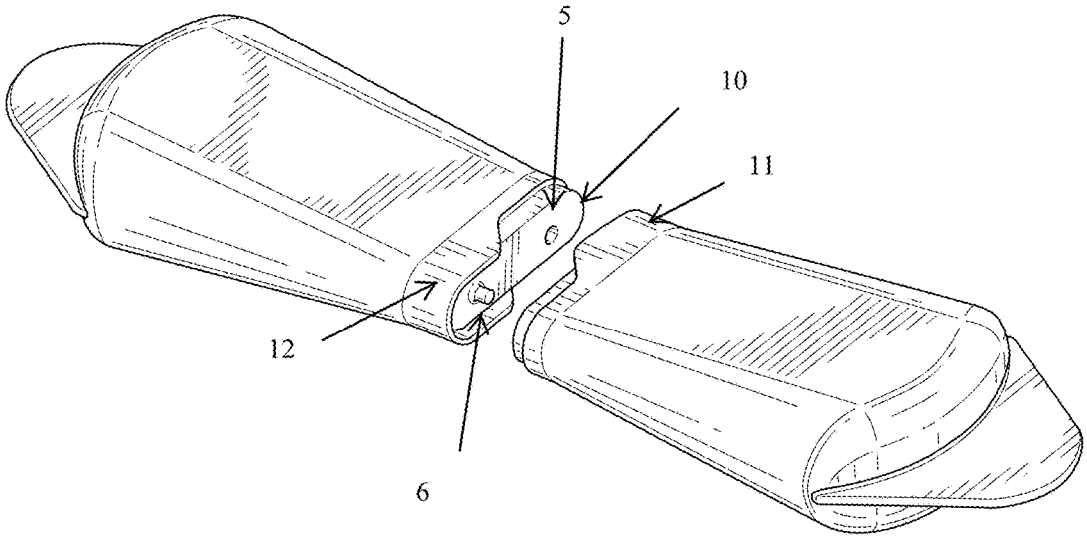
FIG. 3 is a bottom right rear isometric view thereof with the dispenser showing more features between the two chambers.
Figure 4:
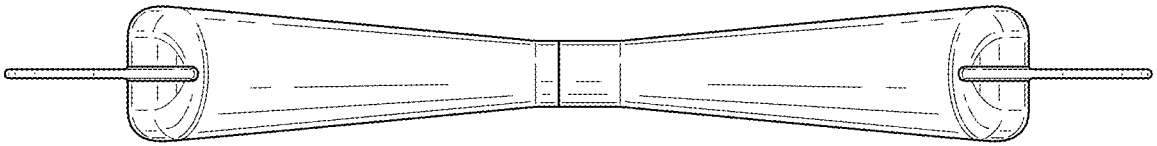
FIG. 4 is a front elevational view thereof.
Figure 5:
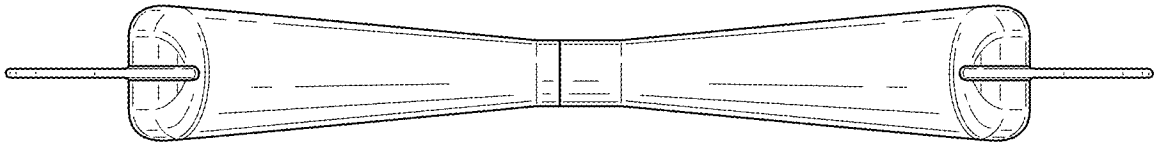
FIG. 5 is a rear elevational view thereof.
Figure 6:
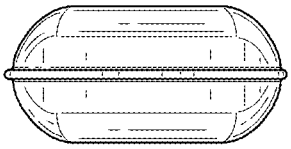
FIG. 6 is a right elevation view thereof.
Figure 7:
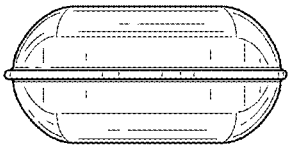
FIG. 7 is a left elevation view thereof.
Figure 8:
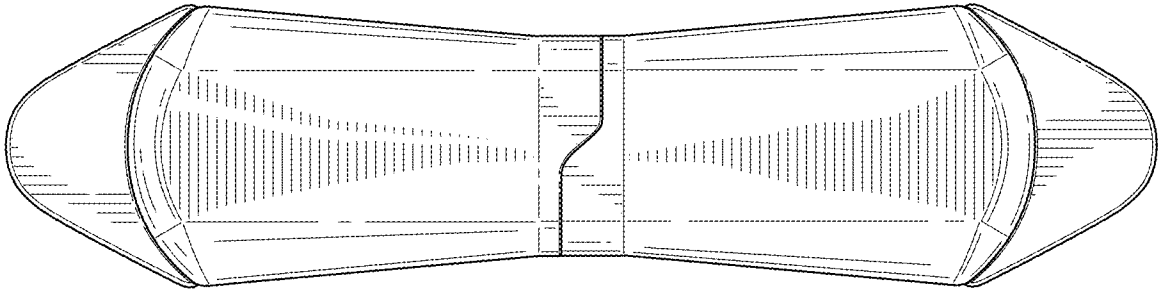
FIG. 8 is a top plan view thereof.
Figure 9:
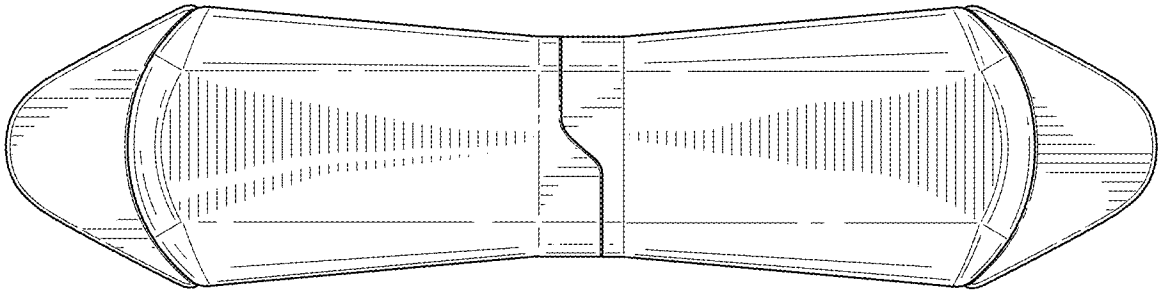
FIG. 9 is a bottom plan view thereof.

FIG. 2 is another view thereof with the dispenser showing more internal features between the two chambers. Container body 1 has first dispenser wall 10 and container body 2 has second dispenser wall 9. Male plug 4 and female orifice 3 are integrally formed on second dispenser wall 9 correspond with the female orifice 5 and the male plug 6 integrally formed on first dispenser wall 10 respectively; that is male plug 4 engages female orifice 5, and female orifice 3 engages male plug 6. Thus, the dispenser can be sealed together preventing flow of the contents when the male and female members are engaged together as described previously and in more detail below with respect to FIG. 20. It should be apparent that the female orifices 3 and 5 each have a passageway therein cutting into the interior space of the container so that a passageway exits within the material of the respective front surface thereby permitting the expulsion of contents therethrough from the container body 2, 1. The two containers are reciprocal units designed to engage the other unit, as seen in FIG. 3. Thus, rotating the dispenser containers shows the corresponding orifices and male members. The containers have a generally tapered structure, with the ends having the widest cross-section and the center, adjacent to the face, having the narrowest cross-section, as seen in FIGS. 4 and 5. The dispenser containers concurrently have an ovoid, or generally oval, transverse cross-section, as seen in FIGS. 6 and 7. The two dispenser containers engage the corresponding container to form a single unit, as seen in FIGS. 8 and 9.

Example Two

Figure 10:
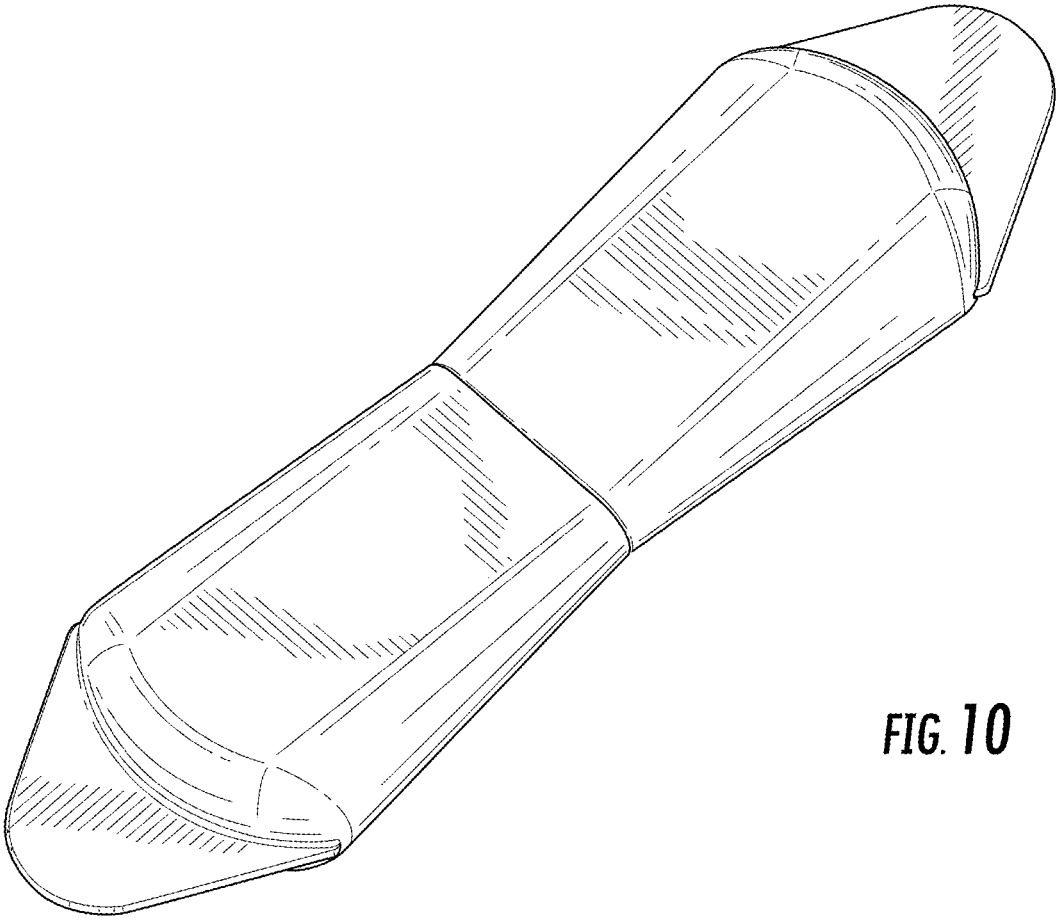
FIG. 10 is an isometric view of a dispenser showing an alternative embodiment.

FIG. 10 is an isometric view of a dispenser showing an alternative embodiment; this alternative embodiment has the dispenser without an overhang having two shrouds 11, 12. That is the two faces do not have this extra support.

Figure 11:
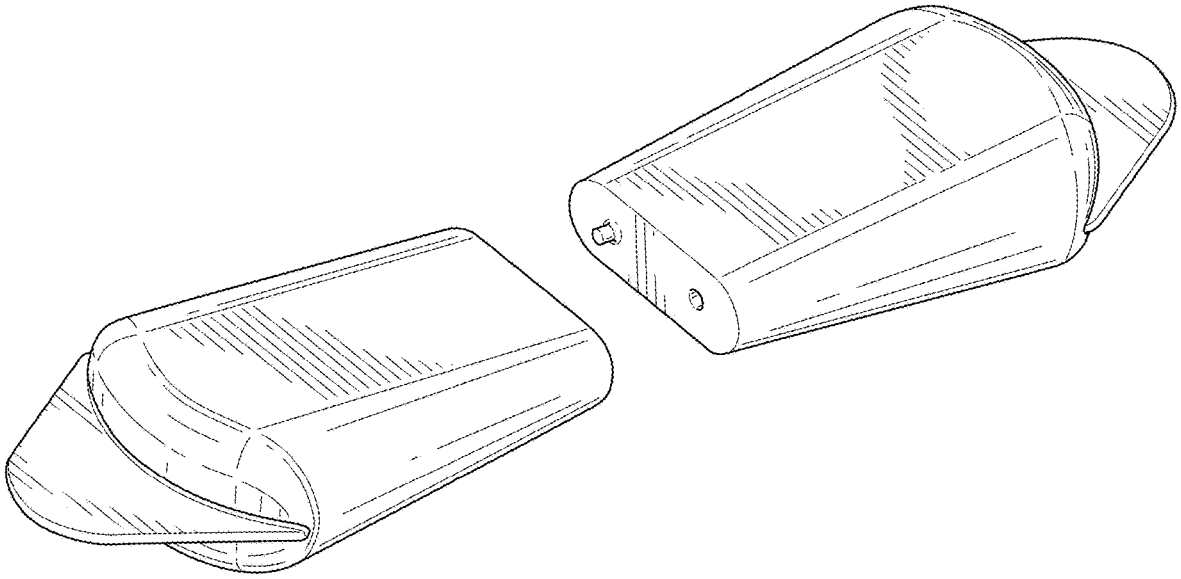
FIG. 11 is a top left front isometric view thereof with the dispenser showing more features between the two chambers.
Figure 12:
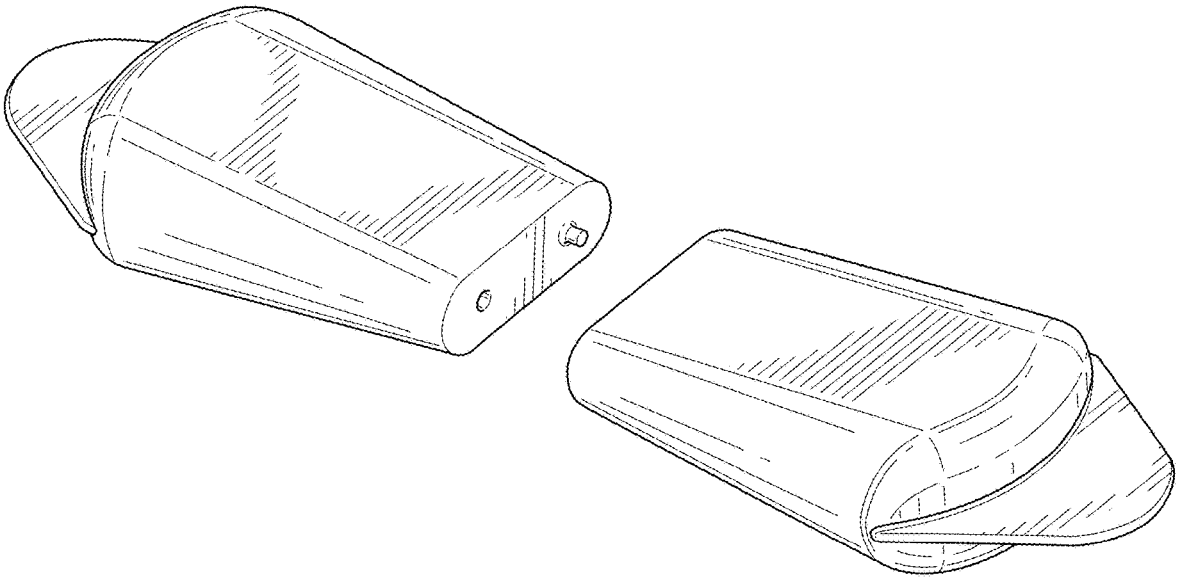
FIG. 12 is a bottom right rear isometric view thereof with the dispenser showing more internal features between the two chambers.
Figure 13:
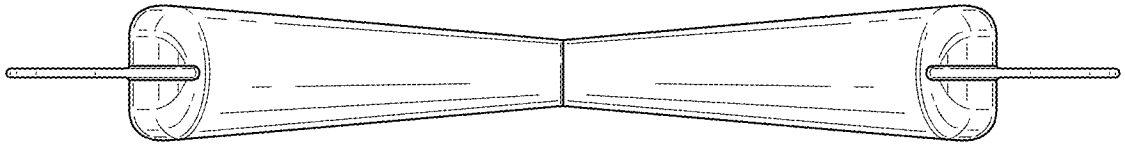
FIG. 13 is a front elevational view thereof.
Figure 14:
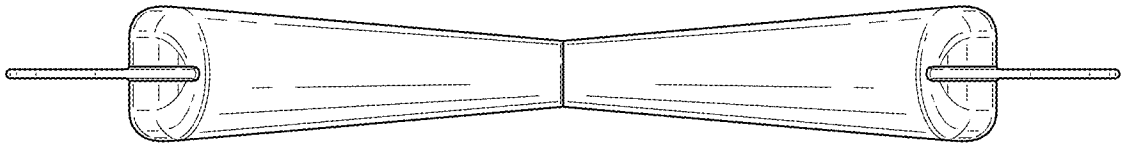
FIG. 14 is a rear elevational view thereof.
Figure 15:
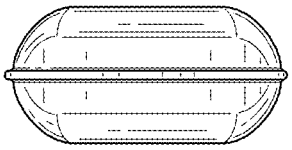
FIG. 15 is a right elevation view thereof.
Figure 16:
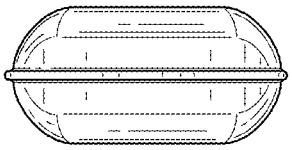
FIG. 16 is a left elevation view thereof.
Figure 17:
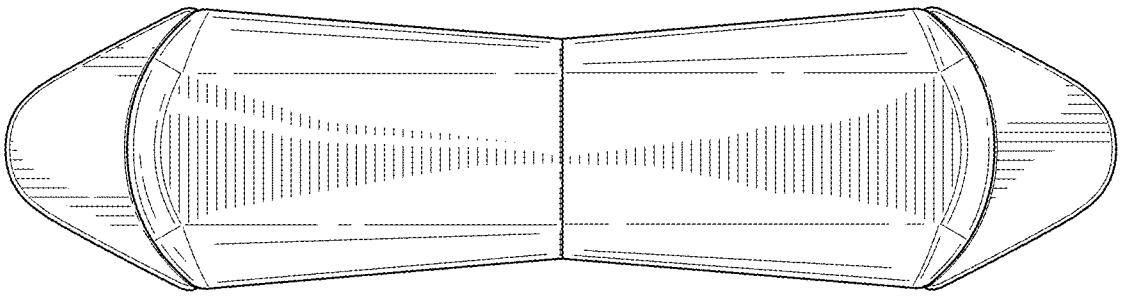
FIG. 17 is a top plan view thereof.
Figure 18:
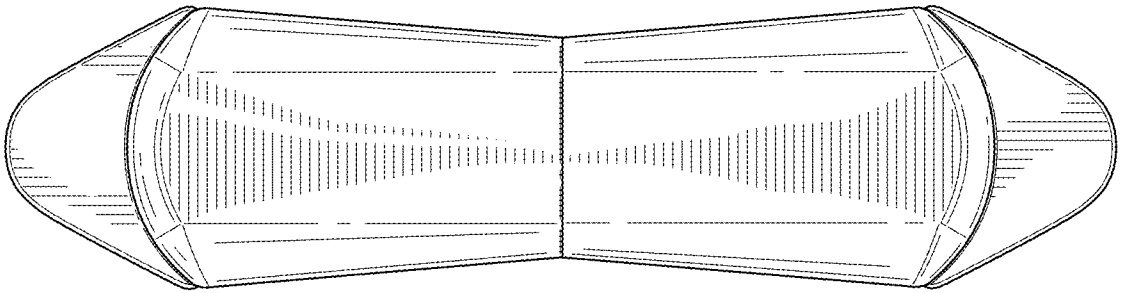
FIG. 18 is a bottom plan view thereof.

The dispenser has two containers each having a container body. The front faces of this embodiment lacks any corresponding shrouds about a part of a single respective front face 9, 10, and therefore the faces of each container engage the opposite parts of the counterpart container. Each container body has a male plug and the female orifice integrally formed on the container; such that male plug of one container engages female orifice of another container, as seen in FIGS. 11 and 12. Thus, the dispenser can be sealed together preventing flow of the contents when the male and female members are engaged together as described previously and in more detail below with respect to FIG. 20. The containers have a generally tapered structure, with the ends having the widest cross-section and the center, adjacent to the face, having the narrowest cross-section, as seen in FIGS. 13 and 14. The dispenser containers concurrently have an ovoid, or generally oval, transverse cross-section, as seen in FIGS. 15 and 16. The two dispenser containers engage the corresponding container to form a single unit, as seen in FIGS. 17 and 18.

Example Three

Figure 19:
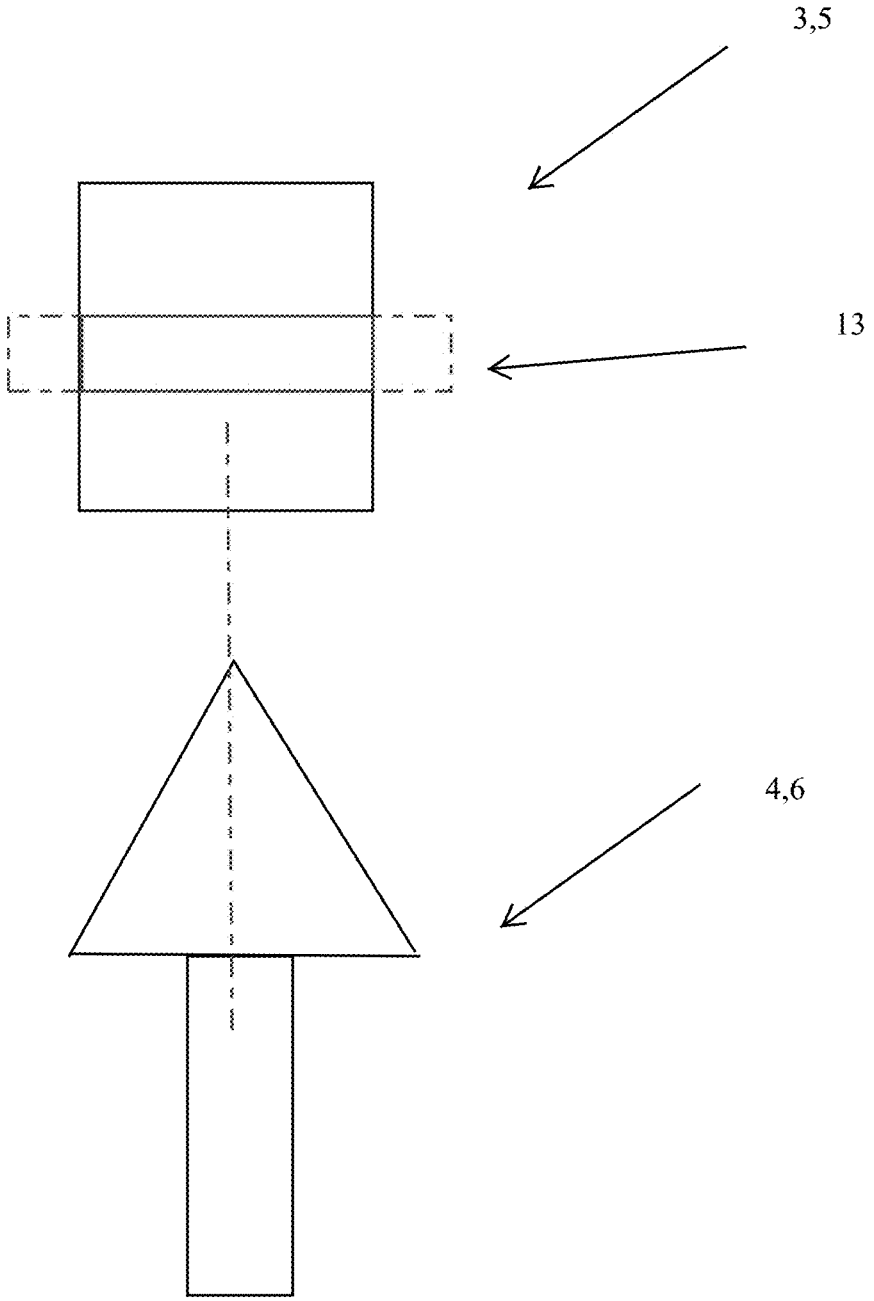
FIG. 19 presents a view of a male member entering a female orifice for engagement therewith.

FIG. 19 presents a view of a male member entering a female orifice for engagement therewith. The male member (4,6) enters a female orifice (5, 3) having a depression 13 running along the inner circumference therein for engagement with the edge of an arrow head of the male member and locking engagement therewith.

Example Four

Figure 20:
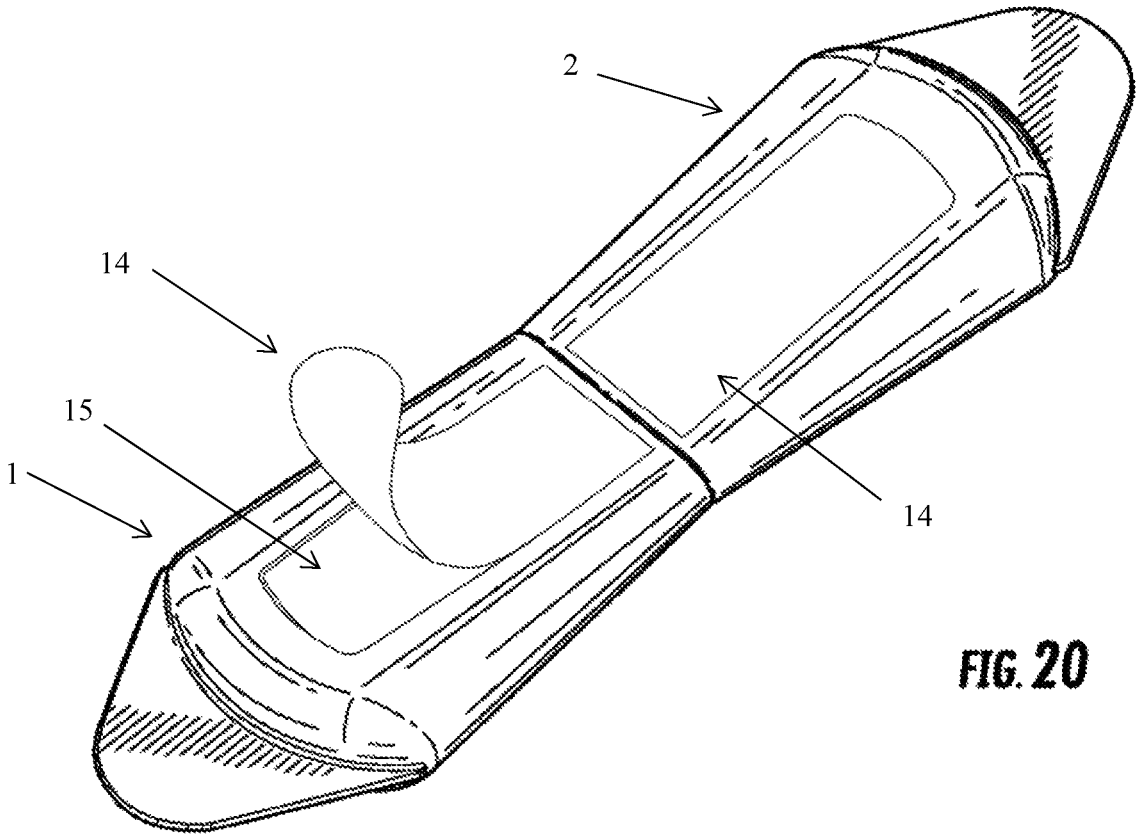
FIG. 20 presents a view of an alternative embodiment having a peel off alternative opening.

FIG. 20 presents a view of an alternative embodiment having a peel off alternative opening. This device is the same exact concept, however contains a foil flap designed for pulling back and dipping, and a thin film of glue to help the foil stick as well. The rectangular foil flap 14 sits atop the container body 1, 2 and its edge has a thin film of weak glue that adheres sufficiently to permit selective removal and replacement of the foil flap repeatedly. Foil flap 14 is used to seal opening 15. The front portion thereof is attached close to back portion of the face of either container body 1, 2.

The above-described embodiments are merely exemplary illustrations of various implementations set forth for a clear understanding of the principles of the invention. Many variations, combinations, modifications or equivalents may be substituted for elements thereof without departing from the spirit and scope of the invention. Therefore, it is intended that the invention not be limited to the particular embodiments as disclosed, but that the invention will include all the embodiments falling within the scope of the appended claims.

What is claimed is:

1. A dispensing container, wherein the dispensing container comprises:

a first liquid or gel dispenser, where the first dispenser comprises:

at least one first dispenser wall;

a front wall disposed on a first end of the at least one first dispenser wall;

an interior space bounded by the at least one first dispenser wall and the front wall;

a first female opening disposed on the front wall and extending into the interior space and in fluid communication with the interior space;

a first male plug disposed on the front wall, wherein the first male plug is adapted to engage a second female opening of a second dispenser;

a second liquid or gel dispenser, where the second dispenser comprises:

at least one second dispenser wall;

a rear wall disposed on a first end of the at least one second dispenser wall;

an interior space bounded by the at least one second dispenser wall and the rear wall;

a female opening disposed on the rear wall and extending into the interior space and in fluid communication with the interior space; and a male plug disposed on the rear wall, wherein the male plug is adapted to engage the first female opening of the first dispenser;

whereby the first male plug of the first dispenser is inserted in the second female opening of the second dispenser and the second male plug of the second dispenser is inserted in the first female opening of the first dispenser when the first dispenser engages the second dispenser to prevent flow of the fluid when the first male plug is engaged in the second female opening and the second male plug is engaged in the first female opening.

2. The dispensing container of claim 1, further comprising a first ovoid wall disposed on a second end of the at least one first dispenser wall and opposite the front wall of the first liquid or gel dispenser; and a second ovoid wall disposed on a second end of the at least one second dispenser wall and opposite the rear wall of the second liquid or gel dispenser.

3. The dispensing container of claim 2, further comprising a first tab disposed on an outer face of the first ovoid wall and a second tab disposed on an outer face of the second ovoid wall.

4. The dispensing container of claim 1, wherein the at least one first dispenser wall is injection molded plastic, flexible foil, polyurethane, or polyethylene.

5. The dispensing container of claim 1, wherein the at least one second dispenser wall is injection molded plastic, flexible foil, polyurethane, or polyethylene.

6. The dispensing container of claim 4, wherein the at least one first dispenser wall further comprises an opening disposed on a portion of the first dispenser wall;

wherein the opening disposed on a portion of the first dispenser wall is sealed by foil.

7. The dispensing container of claim 5, wherein the at least one second dispenser wall further comprises an opening disposed on a portion of the second dispenser wall;

wherein the opening disposed on a portion of the second dispenser wall is sealed by foil.

8. The dispensing container of claim 1, wherein the front wall of the first dispenser is formed of a hard plastic.

9. The dispensing container of claim 8, further comprising a shroud disposed on an exterior face of the front wall of the first dispenser, wherein the shroud comprises a first shroud wall, where the first shroud wall circumscribes a portion of the front wall.

10. The dispensing container of claim 1, wherein the rear wall of the second dispenser is formed of a hard plastic.

11. The dispensing container of claim 10, further comprising a shroud disposed on an exterior face of the rear wall of the second dispenser, wherein the shroud comprises a second shroud wall, where the second shroud wall circumscribes a portion of the rear wall.

12. The dispensing container of claim 1, wherein the at least one first dispenser wall bounds an ovoid cross-section interior space.

13. The dispensing container of claim 1, wherein the at least one second dispenser wall bounds an ovoid cross-section interior space.

14. The dispensing container of claim 1, further comprising a depression disposed on the interior wall of the female opening disposed on the front wall; and further comprising a depression disposed on the interior wall of the female opening disposed on the rear wall.

15. The dispensing container of claim 1, wherein the male plug disposed on the front wall is conical; and wherein the male plug disposed on the rear wall is conical.

* * * * *